US006155184A

United States Patent [19]

Stiefel

[11] Patent Number: 6,155,184

[45] Date of Patent: Dec. 5, 2000

[54] PROCESS FOR INCINERATING SOLIDS ON A WATER-COOLED THRUST COMBUSTION GRATE, AND A GRATE PLATE AND GRATE FOR ACCOMPLISHING THE PROCESS

[75] Inventor: Jakob Stiefel, Kollbrunn, Switzerland

[73] Assignee: Doikos Investments Limited, St. Helier/Jersey, United Kingdom

[21] Appl. No.: 09/179,275

[22] Filed: Oct. 27, 1998

[30] Foreign Application Priority Data

Oct. 29, 1997 [CH] Switzerland ..... 2498/97
May 3, 1998 [CH] Switzerland ..... 0990/98

[51] Int. Cl.[7] ..... F23H 3/02; F23H 3/04; F23H 7/00

[52] U.S. Cl. ..... 110/348; 110/281; 110/300; 110/311; 126/163 R; 126/174; 126/152 B

[58] Field of Search ..... 110/267, 268, 110/281, 286, 287, 288, 298, 299, 300, 310, 311, 312, 313; 126/152 B, 152 R, 163 A, 167, 174, 175, 163 R

[56] References Cited

U.S. PATENT DOCUMENTS 1,140,158 5/1915 Hopes .
1,482,501 2/1924 Zuzulin .
1,542,910 6/1925 Reid .
1,607,258 11/1926 Gibson .
1,779,852 10/1930 Parker .
1,823,235 9/1931 Brydon .
2,033,570 3/1936 Cruikshank .
2,057,276 10/1936 Morgan ..... 110/312
4,719,900 1/1988 Martin ..... 126/163 R
5,575,642 11/1996 Willis et al. ..... 110/299 X
5,673,636 10/1997 Stiefel ..... 110/346
5,992,334 11/1999 Von Wedel ..... 110/298 X
6,024,031 2/2000 Stiefel ..... 110/281

FOREIGN PATENT DOCUMENTS 0 621 449 B1 1/1993 European Pat. Off. .

*Primary Examiner*—Ira S. Lazarus
*Assistant Examiner*—Ljiljana V. Ciric
*Attorney, Agent, or Firm*—Pauley Petersen Kinne & Fejer

[57] ABSTRACT

A process wherein primary air supplied to the combustion bed through the thrust combustion grate is deflected after exiting from a surface of the thrust combustion grate by deflector elements mounted on the surface of the thrust combustion grate. The grate required for this purpose has grate plates made from a permeable hollow element with connection pieces for supplying and draining cooling water, with primary air supply ducts that run through the grate plate from a bottom to a top. Deflector elements against which the primary air exiting the outlet is intended to impact, are disposed over openings of the primary air supply ducts.

10 Claims, 5 Drawing Sheets

PROCESS FOR INCINERATING SOLIDS ON A WATER-COOLED THRUST COMBUSTION GRATE, AND A GRATE PLATE AND GRATE FOR ACCOMPLISHING THE PROCESS

BACKGROUND OF THE INVENTION

1. Field of the Invention

This invention relates to a process for incinerating solids on a water-cooled thrust combustion grate of the type installed, for example, in waste incinerators. This invention also relates to a specific grate plate and a grate having of a number of such grate plates for carrying out the process. The solids to be incinerated can be all kinds of different solids, for example lignite, shavings, chips of wood or rubber, residues of all kinds, industrial waste, sewage sludge, hospital waste or domestic refuse, and the like.

2. Description of Prior Art

In the case of conventional thrust combustion grates of the type installed in waste incinerators and which have layers of grates that rest on top of each other in the manner of a stairway, of which every second one can be moved in a thrust direction, primary air is blown from underneath and through the grate and into a combustion bed. In the case of cast grates, which are still the most widely used type of grate, where the individual layers of grates have of a row of cast grate bars positioned loosely next to each other or screwed to each other, the primary air reaches the upper surface of the grate through holes in the sides and/or the head portion of the cast grate bars. The primary air is blown through the grate by large ventilators in the zones underneath the grate which generate excess pressures equivalent to a column of water of the order of approx. 40 mm to 250 mm. Approximately 2% of each grate surface is reserved as a passage for the primary air, and the volume of air blown through can be up to 2,500 $m^3$ of air per hour per square meter of grate surface. As the air flows through, it can reach peak speeds of over 30 m/s. This air that flows through the grate serves, on the one hand, as primary air for the fire, and, on the other hand, as cooling air for the cast grate. One of the disadvantages of this concept is that the penetration of the combustion bed by the air is very irregular. If, for example, a wire or any other small item lodges itself between two adjacent grate bars, the gap between them is widened at the cost of the gaps between the other grate bars. This means that the volume of air flowing through this gap will not be the same as the volume flowing through the gaps between the other grate bars. Another disadvantage is that, where the calorific value of the combustible material is high and the combustion bed is thin, as occurs repeatedly from spot to spot as the combustible material is transported along the flow of primary air breaks through the combustion bed at that point, creating a high darting flame which carries dust and ash with it far up into the boiler room without completely delivering all the oxygen to the fire. This causes a local excess of air, which has a negative impact on the flue gas.

A substantial improvement in the incineration process is achieved with water-cooled grates comprising hollow grate plates preferably made from sheet metal which advantageously extend over an entire width of the grate. The grate plates have primary air supply ducts, for example, primary air supply pipes that pass through the grate plate, possibly tapering towards the top, or the primary air supply ducts are formed by holes for blowing primary air through, so that the primary air can be blown through the grate from underneath and directed out onto its upper surface. Because the grate plates extend over the entire width, slag can no longer fall through the individual grate elements to end up underneath the grate, as can happen when the layers of grates are made up of a number of grate bars positioned loosely next to each other. This virtually eliminates the problem of falling slag. The great advantage of a water-cooled grate, however, lies in the fact that the air blown through it need only fulfil the function of supplying air for combustion, for example, need not fulfil any cooling function whatsoever. As a result, the volume of air needing to be supplied can be drastically reduced, leading to a much quieter and more efficient fire. The distribution of primary air across the individual primary air supply ducts remains largely even. One remaining disadvantage, however, is that, especially in the event of high calorific values and/or a combustion bed which is thin from spot to spot, the primary air flow exiting from a primary air duct opening located at such a spot can break through the combustion bed.

The overall requirements made of incineration processes are increasing constantly. Because the composition, and hence the calorific value, and also the volume of, for example, domestic waste fluctuates greatly from region to region and season to season, as do its physical characteristics such as specific weight, article size distribution, permeability to air, moisture, ash content, percentage of non-ferrous metals etc., it is not easy always to achieve good combustion of the combustible gases and slag while remaining within the values prescribed by regulations. One objective is to achieve an even distribution of temperature within the gas flow in the boiler room, for which purpose it is essential that the combustion process on the grate and in the furnace chamber above the grate is controlled and even. The finite number of primary air supply lines respective openings, the periodic blockage of individual openings, the irregular volume of loose material and the resultant differences in the heights of the layers of combustible material, plus variations in its calorific value, often lead, however, to uneven combustion.

An insufficient supply of primary air to air-cooled grates can cause the grate to overheat. The combustion zone is prolonged, leading to unsatisfactory combustion of the slag. The lack of air in the furnace chamber has a negative impact on the combustion of gas and on the flow patterns in the boiler room. This in turn leads to excessive soiling of the boiler walls. If individual primary air supply openings become blocked up, this leads to an increase in the speed of the air exiting from the other unblocked openings and, wherever the flow of primary air breaks through the combustion bed (blow-by), to the formation of streaks in the furnace chamber, increased formation of CO and $NO_x$ and an increase in dust emissions. If the nature of the combustible material causes total or partial blockages in the openings on one side of the grate, the combustion bed is rendered uneven, and the combustion process is only satisfactory on one side.

SUMMARY OF THE INVENTION

It is one object of this invention to provide a process by which means primary air can largely be prevented from breaking through the combustion bed, as can blockages of the primary air supply openings, and which makes it possible to reduce the volume of air blown through, to improve the combustion process and hence also to improve the quality of the flue gas. It is another object of this invention to provide a grate plate and a grate that comprises such grate plates, on which this process can be carried out.

The above and other objects are solved by a process for incinerating solids on a thrust combustion grate wherein primary air supplied to the combustion bed through the thrust combustion grate is deflected after the primary air flows through the grate by deflector elements disposed on the surface of the grate. In one preferred embodiment, there is a grate plate and a grate comprised of such grate plates for carrying out the process in line with the features described below and in the claims.

BRIEF DESCRIPTION OF THE DRAWINGS

The drawings show different embodiments of grate plates for constructing a thrust combustion grate suitable for carrying out the process, and the process and the devices will be described, and their advantages explained, with reference to the drawings, wherein.

DESCRIPTION OF PREFERRED EMBODIMENTS

Thrust combustion grates have stationary and movable layers of grates comprising grate plates or a row of grate bars, with the layers of grates resting on top of each other like a stairway. Thrust combustion grates of this kind can be installed in such a way that the combustion bed lies essentially horizontally, or at an angle with angles of up to 20 degrees or more being common. European latent Reference EP 0 621 449 discloses a water-cooled thrust combustion grate with grate plates made from sheet steel which form panel-shaped hollow elements extending over an entire width of the grate path, through which water is directed as a cooling medium. Every second grate plate is movable, and can therefore execute a scraping or a transporting stroke. In the case of a forward feed grate, the leading edge of the movable grate plates can push combustible material forward onto the next grate plate down. In contrast, a reverse feed grate forms something like a sloping stairway built in the wrong way round. In a reverse feed grate, the leading edges of the movable grate plates transport the combustible material behind them backwards, which then rolls back down in the direction of the slope of the grate. The movable grate plates, grate plates disposed in-between two stationary grate plates, are usually moved collectively to and from in the downward direction of their inclination. This ensures that burning refuse lying on the grate for high dwelltimes of 45 to 120 minutes is constantly turned over and distributed evenly over the grate.

Figure 1:
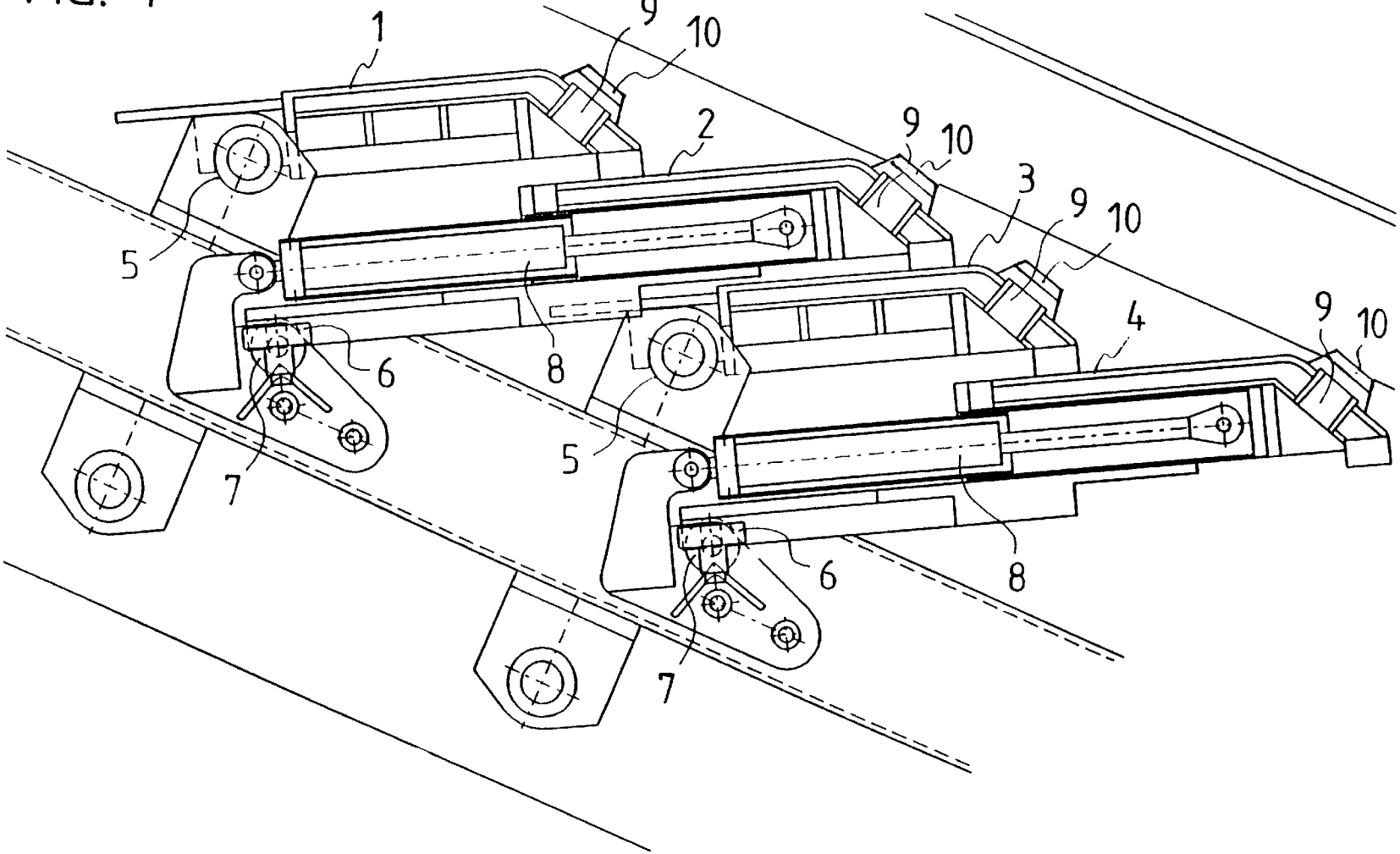
FIG. 1 is a cross-sectional side view of a thrust combustion grate, with deflector elements over openings of the primary air supply ducts that pass through the grate.

One advantageous embodiment of this thrust combustion grate and its main elements is shown in FIG. 1, which shows a cross-section of part of a thrust combustion grate. The grate comprises layers of grates disposed in a stairway manner, each layer being formed by one hollow, water-cooled grate plate 1,2,3,4. Every second grate layer, for example grate plates 2 and 4 in FIG. 1, is movable, while the grate plates in-between are stationary, suspended on cross-bars 5. The movable grate plates 2,4 are each mounted at the side on a roller 6 and rear portions of the moveable grate plates 2, 4 rest on vertical rollers 7, which are disposed along the barriers that define the sides. Each movable grate plate 2,4 is driven by its own hydraulic piston-cylinder unit 8. Pipes 9 for supplying primary air from the zone underneath the grate run through the grate plate and open out at the leading edge of each grate plate. The primary air supply pipes 9 open out slightly above the surface of the grate plate and have a cross-section like an oblong hole, as will be illustrated below. This prevents excessive amounts of slag from falling into the pipes 9. The openings of these primary air pipes 9 or corresponding primary air supply ducts, as shown here, have deflector elements 10 in the form of caps made out of bow-shaped deflector plates, which are simply welded onto the surface of the grate plates. The top section of the deflector plates has a V-shaped cross-section. The flow of primary air impacting from below on the deflector plates is divided by the deflector plates and deflected to the side. At the same time, the bow-shaped deflector plates cover the opening in the direction of movement of the grate, so that the combustible material is guided around the deflector plates and does not pass directly over the primary air openings.

Figure 2:
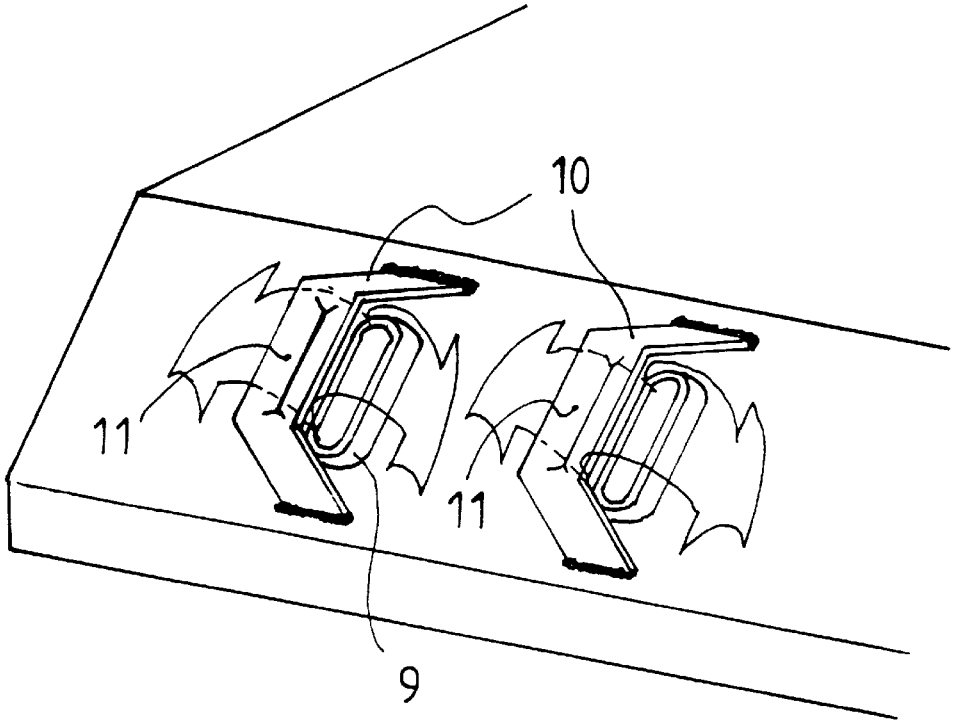
FIG. 2 is a partial perspective view of a grate plate with the deflector elements designed in the form of welded on, bow-shaped deflector plates.

FIG. 2 shows a perspective view of part of the front edge of a grate plate where the deflector elements are designed in the form of welded on bow-shaped deflector plates 10. The primary air supply pipes 9 shaped like oblong holes, which open out one or a few millimeters above the surface of the grate plate. The opening or nozzle caps 10 in the form of the bow-shaped deflector plates 10 are welded on over the openings. The deflector plates 10 are made from sheet steel and, when welded on and viewed from the side, they form a trapezoidal shape, with the piece of sheet metal that forms the top of the trapezium being contrived with a V-shaped cross-section, which can be achieved by a simple bevelling. With this shape the primary air flow impacting from below is divided in two as indicated by the arrows. deflected to the side and whirled up as well. The effect is that the air penetrates the combustion bed diffusely, so to speak, and at a substantially reduced speed. The air which flows through the primary air openings disposed in a row is able to penetrate the combustion bed diffusely across its entire width, so that the oxygen in the air is supplied to the combustion much more homogeneously than previously. Instead of the bow-shaped deflector plates 10 shown in FIG. 2, they can also be shaped in the form of a semicircular arch or an angle welded onto the grate plate over the opening like a gable. The deflector plates can be mounted in any direction, for example so that the plane of the angle can also run at a right angle to the direction of thrust. By mounting the deflector plates as shown in FIG. 2, one can also prevent blockages in the primary air supply openings.

Figure 3:
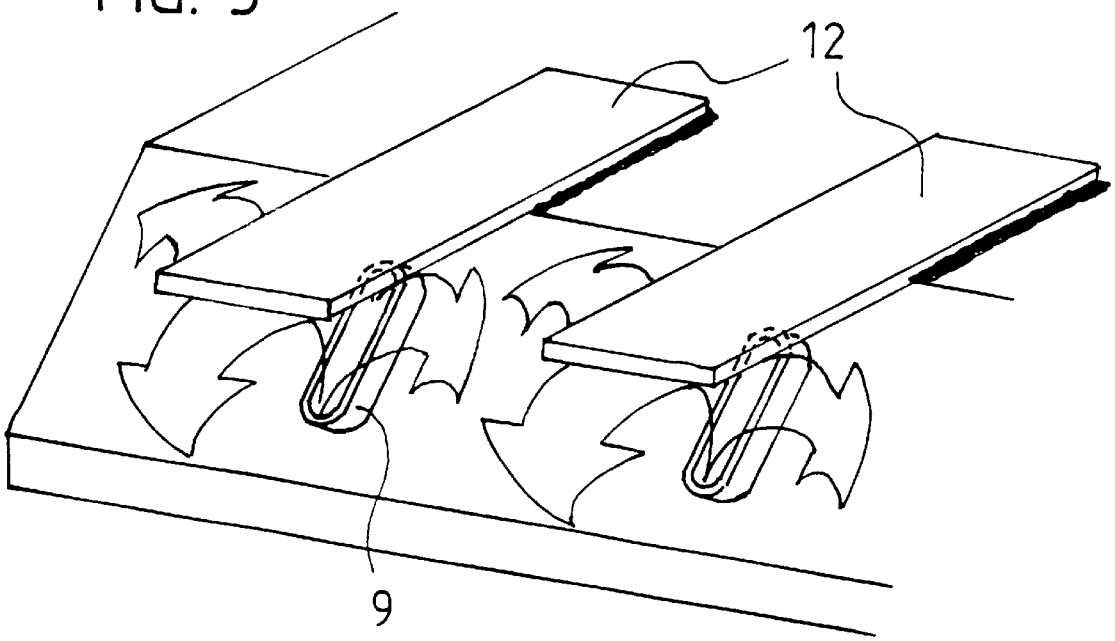
FIG. 3 is a partial perspective view of a grate plate with the deflector elements designed in the form of welded on, flat deflector plates.

FIG. 3 shows a grate plate where the deflector elements are designed as flat, welded on deflector plates 12. This embodiment fulfils the given objective, to deflect the primary air and diffuse it, as indicated by the arrows in FIG. 3. The flat deflector plates 12 can also act as barbs, and with every forward thrust of the moveable plates can carry with them the combustible material lying in the area in front of the flat deflector plates 12, while they then clear this area again as they pull back, whereupon the primary air can again flow against and cool the flat deflector plates 12. The combustible material lying on the grate in the vertical direction above flat plates 12 is separated by this carrying along action, and a horizontal displacement of the layers of the combustion bed takes place. Blockage of the primary air supply openings can also be prevented because when the next grate layer down moves away relative to the supply openings, any material that has lodged itself under flat deflector plate 12 during the previous opposite relative movement works itself free and unblocks the opening again.

Figure 4:
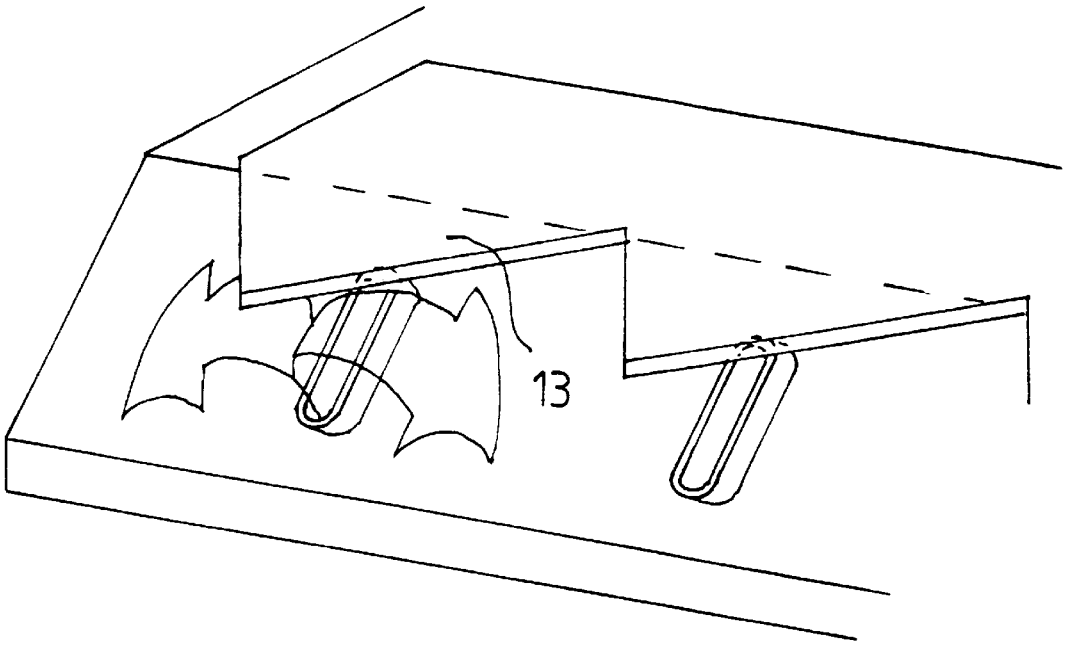
FIG. 4 is a partial perspective view of a grate plate with the deflector elements designed in the form of a welded on, sawtooth patterned steel sheet.

FIG. 4 shows another embodiment of a deflector element, where a sawtooth shaped sheet 13, similar to the shape of a mower blade, is welded onto the front edge of the grate plate across the width of the grate. Each sawtooth projects over a primary air supply nozzle so that the exiting flow of primary air impacts against a sawtooth and is deflected forwards and around the two sides. A horizontal displacement of the combustion bed layers can be achieved with this embodiment too, and blockage of the primary air supply openings can be prevented as well.

Figure 5:
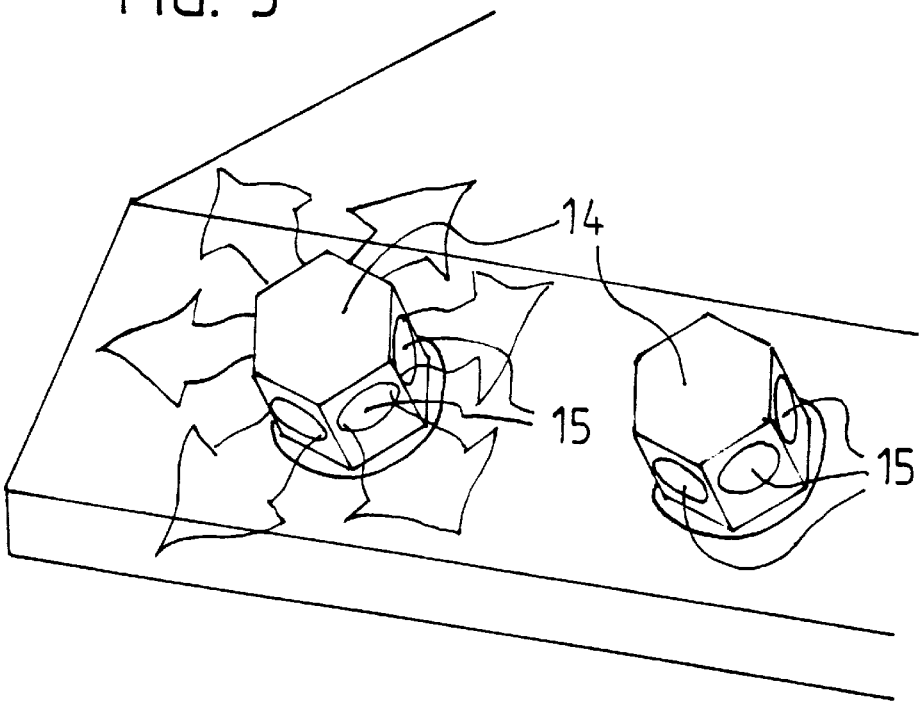
FIG. 5 is a partial perspective view of a grate plate with the deflector elements designed in the form of screwed on caps.

FIG. 5 shows an embodiment with screwed on opening or nozzle caps 14. In this embodiment, the primary air supply ducts or pipes are circular and the pipe openings, which project slightly beyond the grate plate surface, have an outer thread onto which the nozzle cap 14 is screwed. The nozzle caps 14 can be conventional fittings with a hexagonal outer shape which have radial holes 15 for this application. The fittings are only screwed on over a small part of their thread so that the primary air can freely flow out through radial holes 15. After exiting the pipe opening, the primary air is then deflected by the fittings and flows radially through and out of the holes, of which there are six in the embodiment shown in FIG. 5, whereby it is diffused on all sides into the surrounding combustible material as indicated by the arrows. Any blockage of the openings around the nozzle caps 14 is eliminated because of the movement of the opening and nozzle caps 14 relative to the transported combustible material. Nozzle caps of this type can have other shapes, and can be welded instead of screwed.

Figures 6A, 6B:
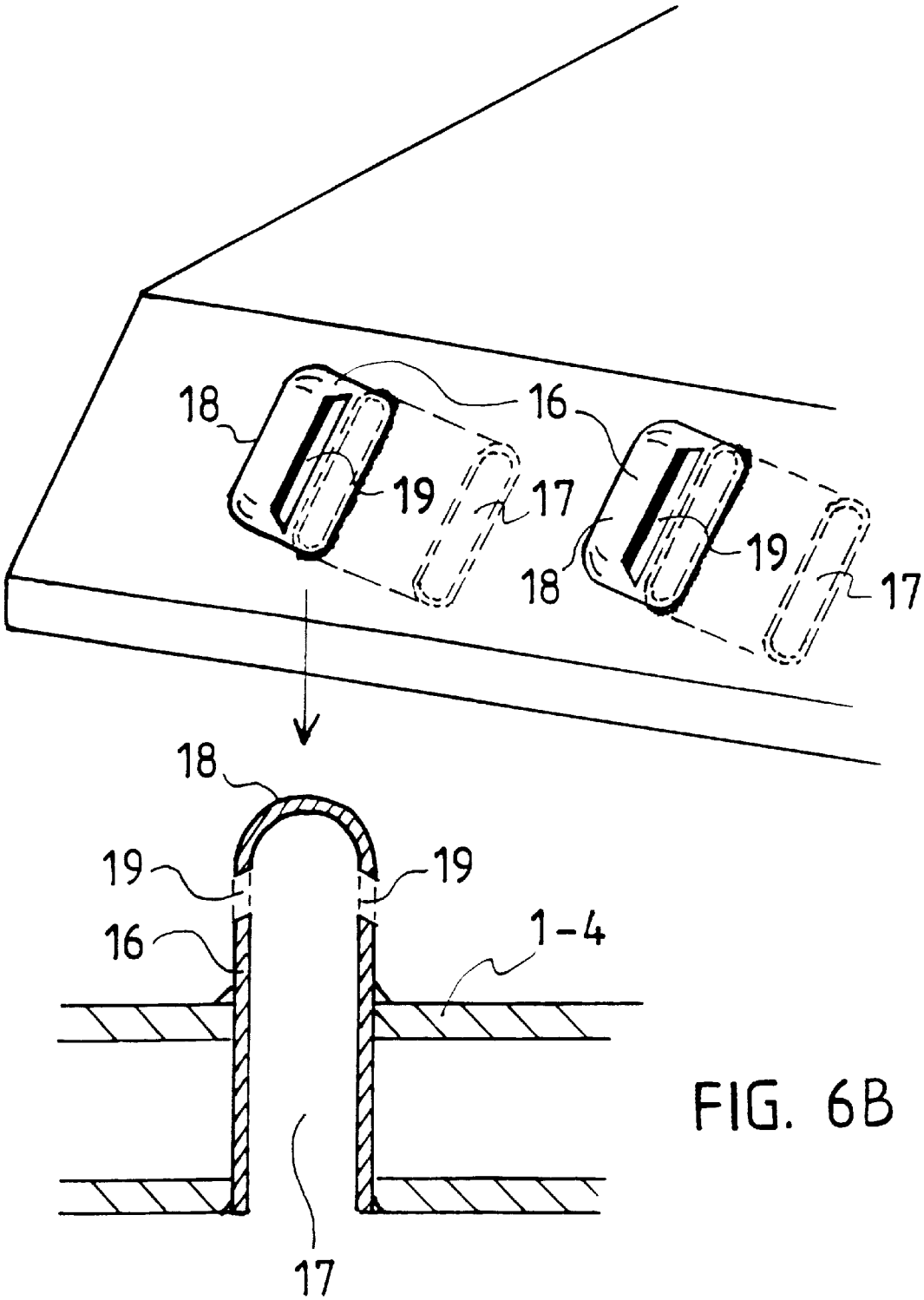
FIG. 6A is a partial perspective view of a grate plate with the deflector elements designed in the form of welded in pipes with cap shaped ends.
FIG. 6B is a partial cross-sectional view of one of the deflector elements, as shown in FIG. 6A.

FIG. 6A shows another embodiment of the deflector elements. The pipes 16 have a cross-section 17 like an oblong hole. The pipes 16 are sealed at one end, where they form a rounded cap 18. The pipes 16 have an open end inserted downwards into corresponding oblong holes in the top and bottom grate plate sheet and welded imperviously into these oblong holes. The length of the pipes is greater than the thickness of the grate plate and as they are welded into the latter with their bottom end flush with the underside of the grate plate, the cap end projects beyond the surface of the grate plate. On both sides of the section of pipes 16 that projects beyond the grate plate, slots 19 are below the caps 18 in the straight portions, which in pipe 16 are directed from inside to outside and downwards. First, this ensures that the air is deflected inside the cap 18, and then flows, depending on how the slots 19 in the caps 18 are positioned, upwards, horizontally or downwards at an angle through the slots 19 onto the bed of refuse. Secondly, this arrangement largely prevents the slots 19 from becoming blocked by combustible material because the slots 19 only move along the combustible material and are, as already mentioned, directed downwards. Because of the rounded caps 18, the sections of pipe that project beyond the surface of the grate plate can virtually travel through the combustible material along with the transported grate plates, and the combustible material can be pushed past these sections of pipe without sticking on sharp edges and causing damage to the pipe 16 or even dislocating the pipe 16 completely.

As a general rule, it is only possible to realize deflector elements like the ones described in the Figures, such as positioned on the surface of the grate, on water-cooled grates which remain at a low temperature in operation so that a large part of the heat is conducted away from the deflector elements to the grate. On air-cooled grates, however, elements of this type would burn within a very short time.

A thrust combustion grate comprising water-cooled grate plates can, therefore, be fitted with deflector elements of this type, thereby ensuring that the primary air supplied to the combustion bed through the thrust combustion grate is deflected immediately after exiting from the surface of the thrust grate. The resultant diffusion of the primary air and consequently more homogeneous penetration of the combustion bed is enormously advantageous for the quality of the combustion. The qualitative impact of the supply of oxygen is discussed below.

Figure 7:
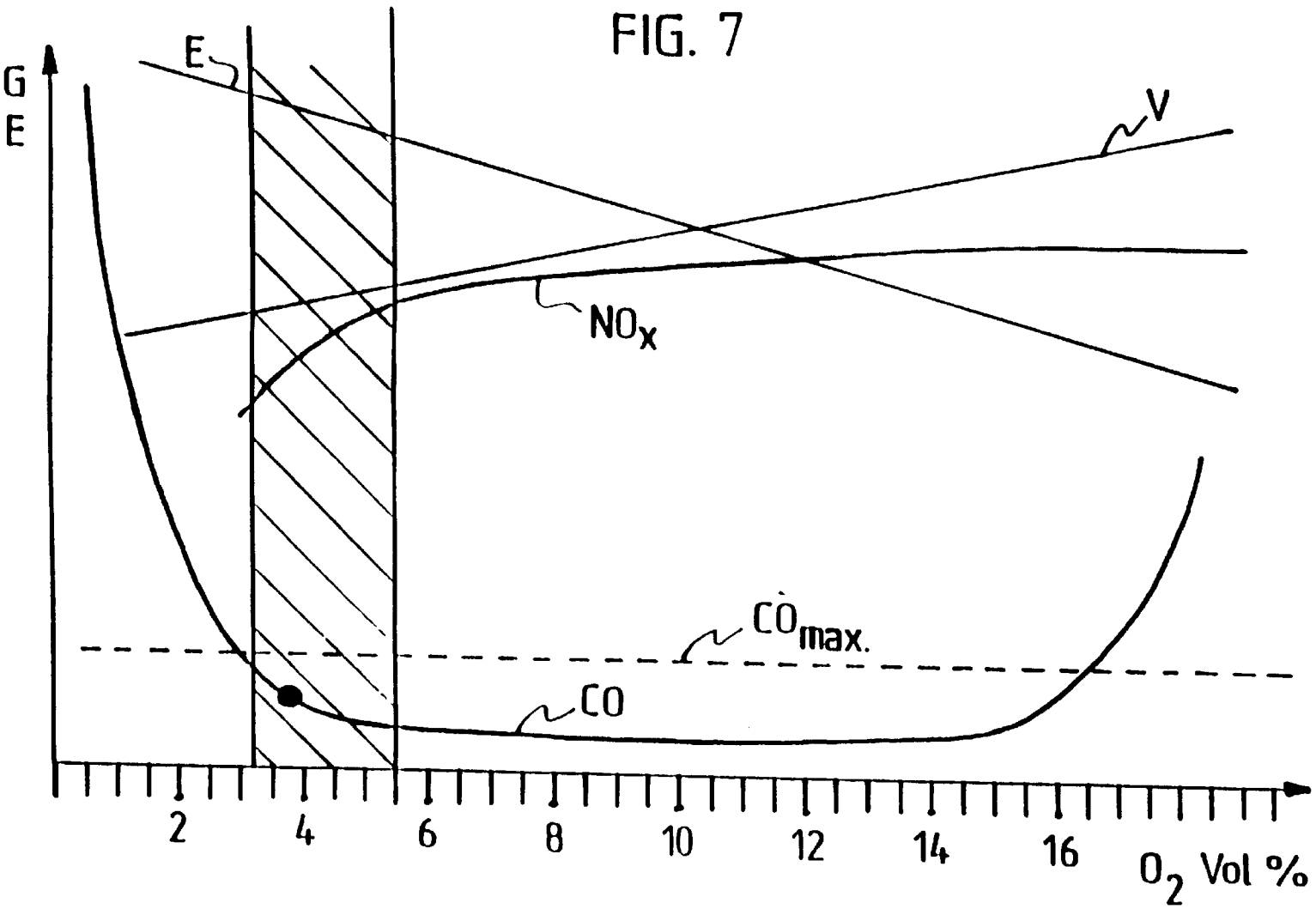
FIG. 7 is a diagram showing flue gases G and the efficiency of the plant E as a function of the $O_2$ content in flue gas G.

FIG. 7 shows a diagram for assessing the quality of the combustion, showing the flue gases G, and the efficiency of the incinerator E, as a function of the $O_2$ content in the flue gases G. The CO value is taken as the predominant measure of the quality of the combustion. The diagram shows that the CO limit value ($CO_{max}$) is adhered to over a relatively large bandwidth of the $O_2$ content in the flue gas. As the $O_2$ content decreases, the $NO_x$ content decreases, too, and the efficiency F of the incinerator increases while the gas volume flow V decreases simultaneously. If, however, the $O_2$ content is reduced beyond a certain degree, the CO value suddenly increases sharply. The aim, therefore, of the combustion control process is to keep the $O_2$ value low enough to minimize the $NO_x$ content while simultaneously adhering to the CO limit value. Such an ideal working point is shown on the diagram. It guarantees both compliance with the flue gas values required by regulations and high operating efficiency. This process optimizes the supply of oxygen so that less air has to be blown through the combustible material. Hence one moves closer to the basic objective of achieving stoichiometric combustion. Dust emissions are also reduced, as is the speed of the dust particles. This reduces the erosion of the boiler walls because many fast-moving dust particles impact on the boiler walls like sandblasting.

Tests in a waste incinerator have shown that by using this process, the excess pressure below the grate was able to be reduced to a third of the value otherwise required, while it was still possible to adhere to the flue gas quality prescribed by the law. This means that instead of large volumes of air flowing at high speed through the grate and the combustible material in an uncontrolled manner at certain points, a controlled volume of oxygen is diffused very gently, such as at low flow rates, through the combustible material. This prevents unnecessary volumes of flue gas from developing, substantially reduces the speed of the flue gas and hence the occurrence of fly ash as well. Furthermore, any small amount of fly ash is no longer whirled up high into the boiler. All this allows the boiler and all downstream plant components to be made smaller, thereby achieving greater cost-efficiency.

What is claimed is:

1. A process for incinerating solids on a thrust combustion grate, the process comprising: supplying primary air from underneath a hollow water-cooled grate plate (1-4), passing the primary air through a plurality of primary air supply ducts (9) that pass through the grate plate (1-4), deflecting the primary air supplied to a combustion bed after the primary air flows through the grate plate (1-4) against a plurality of deflector elements (10,12,13,14,16) disposed on a surface of the thrust combustion grate; and after impacting against the deflector elements (10,12,13,14,16) the primary air flowing diffusely into the combustion bed at a reduced speed.

2. In the process of claim 1, wherein the primary air flow flows through a plurality of pipes (16) welded into the grate plate (1-4) which project beyond a surface of the grate plate (1-4) and the pipes (16) are closed at a top of each of the pipes (16), and the pipes (16) have slots (19) in a plurality of sides oriented one of obliquely upwards, downwards and horizontally so that the primary air exiting through the slots (19) flows diffusely into the combustion bed where the primary air contributes to creating a homogeneous, low speed airflow.

3. In the process of claim 1, wherein the deflector elements (10) are bow-shaped and are disposed over the openings of the primary air supply ducts (9) which are shaped like oblong holes running in a direction of thrust and which form an arch over the openings, and the primary air flow exiting each of the openings is divided and deflected by the deflector elements (10), so that the primary air flows diffusely into the combustion bed where the primary air contributes to creating a homogeneous, low speed airflow.

4. A grate plate for a thrust combustion grate for incineration of solids, comprising: a permeable hollow element (1-4) with a plurality of connection pieces for supplying and draining cooling water, a plurality of primary air supply ducts (9) passing through the grate plate, a plurality of deflector elements (10,12,13,14,16) disposed on a surface of the grate plate over a plurality of openings of the primary air supply ducts (9), against which the primary air exiting the opening impacts; and the deflector elements (16) formed as pipes (16) with a cross-section (17) formed as an oblong hole and sealed at one end to form a rounded cap (18) being inserted with an open end downward into corresponding ones of the oblong holes in a top grate plate sheet and a bottom grate plate sheet and welded impermeably into the oblong holes, the cap ends (18) projecting beyond the surface of the grate plate, and on both sides of a section projecting beyond the grate plate have a plurality of slots (19) below the caps (18) in straight areas, which are in the pipes (16) and run from an inside to an outside and are oriented one of downwards, upwards and horizontally.

5. A grate plate for a thrust combustion grate for incineration of solids, comprising: a permeable hollow element (1-4) with a plurality of connection pieces for supplying and draining cooling water, a plurality of primary air supply ducts (9) passing through the grate plate, a plurality of deflector elements (10,12,13,14,16) disposed on a surface of the grate plate over a plurality of openings of the primary air supply ducts (9), against which the primary air exiting the opening impacts; and the deflector elements formed as one of bow-shaped deflector plates (10) and flat plates (12) projecting beyond the openings at an oblique angle and are welded on over the openings of the primary air supply ducts (9), and the primary air exiting the openings impacting against the one of the bow-shaped deflector plates and the flat plates (12).

6. A grate plate for a thrust combustion grate for incineration of solids, comprising: a permeable hollow element (1-4) with a plurality of connection pieces for supplying and draining cooling water, a plurality of primary air supply ducts (9) passing through the grate plate, a plurality of deflector elements (10, 12,13,14,16) disposed on a surface of the grate plate over a plurality of openings of the primary air supply ducts (9), against which the primary air exiting the opening impacts; and a sawtooth shaped steel sheet (13) welded along a front edge of the grate plate, and each of a plurality of sawteeth projecting over a corresponding one of the openings of the primary air supply duct at an oblique angle, against which the primary air exiting the openings impacts.

7. A grate plate for a thrust combustion grate for incineration of solids, comprising: a permeable hollow element (1-4) with a plurality of connection pieces for supplying and draining cooling water, a plurality of primary air supply ducts (9) passing through the grate plate, a plurality of deflector elements (10,12,13,14,16) disposed on a surface of the grate plate over a plurality of openings of the primary air supply ducts (9), against which the primary air exiting the opening impacts; and the deflector elements formed as nozzle caps (14) having a plurality of radial holes (15) for diffusing the primary air that impacts against the deflector elements mounted over circularly shaped openings of the primary air supply ducts (9).

8. A thrust combustion grate for incinerating solids comprising a plurality of grate plates (1-4) resting on top of each other in a manner of a stairway, each of the grate plates (1-4) comprising a permeable hollow element with a plurality of connecting pieces for supplying and draining cooling water, with a plurality of primary air supply ducts (9) running through the grate plate, wherein the deflector elements (10,12,13,14,16) are disposed over a plurality of openings of the primary air supply ducts (9) against which the primary air exiting from the openings impacts.

9. A process for incinerating solids on a thrust combustion grate, the process comprising: supplying primary air from underneath a hollow water-cooled grate plate (1-4), passing the primary air through a plurality of primary air supply ducts (9) that pass through the grate plate (1-4), and deflecting the primary air supplied to a combustion bed after the primary air flows through the grate plate (1-4) against a plurality of deflector elements (10,12,13,14,16) disposed on a surface of the thrust combustion grate; the primary air flow flowing through the deflector elements comprising a plurality of pipes (16) welded into the grate plates (1-4) which project beyond a surface of the grate plates (1-4) and are closed at a top of each of the pipes (16), and the pipes (16) having slots (19) in a plurality of sides oriented one of obliquely upwards, downwards and horizontally so that the primary air exiting through the slots (19) flows diffusely into the combustion bed where the primary air contributes to creating a homogeneous, low speed airflow.

10. A process for incinerating solids on a thrust combustion grate, the process comprising: supplying primary air from underneath a hollow water-cooled grate plate (1-4), passing the primary air through a plurality of primary air supply ducts (9) that pass through the grate plate (1-4), and deflecting the primary air supplied to a combustion bed after the primary air flows through the grate plate (1-4) against a plurality of deflector elements (10,12,13,14,16) disposed on a surface of the thrust combustion grate; the deflector elements (10) being bow-shaped and disposed over the openings of the primary air supply ducts (9) which are shaped like oblong holes running in a direction of thrust and which form an arch over the openings, and the primary air flow exiting each of the openings being divided and deflected by the deflector element (10), so that the primary air flows diffusely into the combustion bed material where the primary air contributes to creating a homogeneous, low speed airflow.

* * * * *